United States Patent [19]

Yamasaki et al.

[11] Patent Number: 5,067,465

[45] Date of Patent: Nov. 26, 1991

[54] LEAN BURN INTERNAL COMBUSTION ENGINE

[75] Inventors: Hirofumi Yamasaki, Kakogawa; Kiyoshi Yagi, Kobe; Keisuke Tsukamoto, Toyota; Toshio Takaoka, Toyota; Takao Fukuma, Toyota, all of Japan

[73] Assignees: Fujitsu Ten Limited, Kobe; Toyota Jidosha Kabushiki Kaisha, Toyota, both of Japan

[21] Appl. No.: 655,646

[22] Filed: Feb. 14, 1991

[30] Foreign Application Priority Data

Feb. 15, 1990 [JP] Japan ..... 2-34986
Feb. 15, 1990 [JP] Japan ..... 2-34988

[51] Int. Cl.[5] ..... F02D 41/14
[52] U.S. Cl. ..... 123/489
[58] Field of Search ..... 123/440, 489; 204/424, 204/425, 426

[56] References Cited

U.S. PATENT DOCUMENTS

| | | | |
|---|---|---|---|
| 4,365,604 | 12/1982 | Sone | 123/440 |
| 4,520,783 | 6/1985 | Matsushita et al. | 123/492 |
| 4,611,562 | 9/1986 | Nakano et al. | 123/489 X |
| 4,651,700 | 3/1987 | Kobayashi et al. | 123/489 |
| 4,694,809 | 9/1987 | Nakano et al. | 123/489 |
| 4,715,343 | 12/1987 | Kinoshita | 123/489 |
| 4,719,888 | 1/1988 | Kobayashi et al. | 123/440 |
| 4,825,837 | 5/1989 | Nakagawa | 123/489 |
| 4,911,130 | 3/1990 | Takahashi et al. | 123/489 |
| 4,938,196 | 7/1990 | Hoshi et al. | 123/489 |
| 4,976,242 | 12/1990 | Sonoda et al. | 123/489 |
| 4,991,559 | 2/1991 | Osawa et al. | 123/489 |

FOREIGN PATENT DOCUMENTS

| | | |
|---|---|---|
| 58-59327 | 4/1983 | Japan . |
| 59-42963 | 3/1984 | Japan . |
| 60-202350 | 10/1985 | Japan . |
| 60-235046 | 11/1985 | Japan . |
| 60-249637 | 12/1985 | Japan . |
| 61-241653 | 10/1986 | Japan . |
| 62-199943 | 9/1987 | Japan . |

*Primary Examiner*—Willis R. Wolfe
*Attorney, Agent, or Firm*—Cushman, Darby & Cushman

[57] ABSTRACT

A lean burn internal combustion engine wherein a basic fuel amount is calculated from a map based on the intake pressure and the engine speed, and a lean correction factor, which is multiplied by the basic fuel amount, is calculated from a lean map based on the intake pressure and engine speed. A second lean map based on the throttle opening and engine speed is provided for obtaining a lean correction factor when the degree of opening of the throttle valve is larger than a predetermined value. A lean sensor is provided for obtaining a signal indicating the air fuel ratio for carrying out a feedback control. The lean sensor is provided with a heater for controlling the temperature of the sensing element of the heater. A basic map for the heater power, which is based on the intake pressure and engine speed, is provided, and a correction map for the heater power is provided for reducing the heater power from the value obtained from the basic map when the lean map based on the intake pressure and engine speed is employed for obtaining the lean air-fuel mixture, to prevent thermal damage to the sensor element.

6 Claims, 16 Drawing Sheets

NE
NEo

XO
1
0
180S

40S
XL
1
0

KL
HIGH
LOW
128S
t0
t1
t3
t4

LEAN BURN INTERNAL COMBUSTION ENGINE

BACKGROUND OF THE INVENTION

1. Field of the Invention

The present invention relates to a lean burn internal combustion engine, and in particular, relates to a control of the temperature of a lean sensor used in such an engine for a detection of the air-fuel ratio therein.

2. Description of Related Art

Known in a prior art is a lean burn combustion engine having an operating area, for example, a low load condition, wherein a lean combustible mixture is introduced into the engine to increase the fuel consumption efficiency. In the lean burn engine, a basic fuel injection amount, which is an amount of fuel needed for providing a theoretical air-fuel ratio at a combination of an engine speed and an engine load parameter such as the intake pressure, is first calculated and then, to obtain the lean air-fuel mixture, a lean correction factor having a value smaller than 1.0 is multiplied by the basic fuel injection amount. A lean correction factor map is provided and is constructed by values of the lean correction factor with respect to combinations of the engine speed and the intake pressure. When the engine enters a power area from the lean area, due to a depression of an accelerator pedal, a fuel enrichment correction is carried out to obtain a desired engine torque.

To obtain a desired air-fuel ratio, a lean sensor is provide in the exhaust pipe of the engine. This lean sensor comprises a solid electrolyte body, such as zirconia, having opposite surfaces on which electrodes are formed, and a diffusion velocity control layer formed on one of the electrodes and in contact with the exhaust gas to be detected. A voltage control means is provided for obtaining a predetermined voltage across the electrodes, to obtain a pumping electric current for generating a flow of oxygen ions from the exhaust gas to be detected, via the speed control layer, under a diffusion condition; this pumping electric current is proportional to the air-fuel ratio.

The lean sensor is usually provided with a heater for obtaining a predetermined temperature of the body, to provide a desired output characteristic. When a constant electric current is applied to the heater, the temperature will change in accordance with that of the exhaust gas, which varies in accordance with the engine speed and engine torque. Therefore, to compensate for this change in the temperature of the exhaust gas, a system has been proposed wherein an electric current applied to the heater is controlled in accordance with the engine speed and an engine torque parameter such as the intake pressure, to obtain a predetermined constant temperature. To accomplish this, a map of values of the electric current applied to the heater with respect to combinations of the engine speed and the intake pressure, as an engine load parameter, is provided. A map interpolation calculation is carried out to obtain a value of the electric current applied to the heater in accordance with a detected combination of the engine speed and the intake pressure. See Japanese Unexamined Patent Publication No. 60-235046.

Nevertheless, sometimes the obtained temperature of the heater is different from the value calculated from the engine speed and the engine torque. When the engine state is changed by an opening of the throttle valve, in place of a lean air-fuel ratio map based on an intake pressure and engine speed, a second lean air-fuel ratio map is employed to obtain a less lean air-fuel mixture, to thereby obtain a desired increase in the torque, as disclosed in allowed U.S. patent application Ser. No. 528,565, filed on May 24, 1990. As a result of the employment of a less lean air-mixture, the temperature of the exhaust gas becomes higher than that obtained when the lean air-fuel mixture is employed, and accordingly, sometimes the temperature of the sensor element is excessively increased when the heater current is calculated from the basic map based on the intake pressure.

SUMMARY OF THE INVENTION

An object of the present invention is to prevent an overheating of the sensor element when a lean map based on the throttle opening is used to obtain a lean air-fuel mixture.

According to the present invention, a lean burn internal combustion engine is provided, comprising:

an engine body;

an intake line for introducing intake air into the engine body;

a throttle valve in the intake line for controlling the amount of air to be introduced into the engine body;

fuel supply means for supplying an amount of fuel into the intake line for producing a lean air-fuel mixture;

an exhaust line for removing resultant exhaust gas from the engine body;

means for detecting an intake pressure in the intake line of the engine;

means for calculating, based on the detected intake pressure, a basic amount of fuel to be supplied to the engine;

means for detecting a degree of opening of the throttle valve;

means for correcting, based on the detected degree of opening of the throttle valve, the basic fuel amount needed to obtain a lean air-fuel mixture;

means for operating the fuel supply means so that the calculated amount of fuel is supplied to the engine body;

sensor means arranged in the exhaust system for detecting an air-fuel ratio, the sensor means having a sensing element in contact with the exhaust gas and a heater means for obtaining a temperature of the sensing element when activated;

feedback means for carrying out a feedback control of the air-fuel ratio when necessary, to ensure that the detected air-fuel ratio corresponds to the desired air-fuel ratio;

means for controlling the electric current in the heater means, based on the detected intake pressure, and;

means, based on the degree of opening of the throttle valve, for reducing the value of an electric current applied to the heater from that obtained in accordance with the intake pressure, to thereby prevent an overheating of the sensor element.

DESCRIPTION OF THE PREFERRED EMBODIMENTS

The present invention will be described with reference to the attached drawings.

Figure 1:
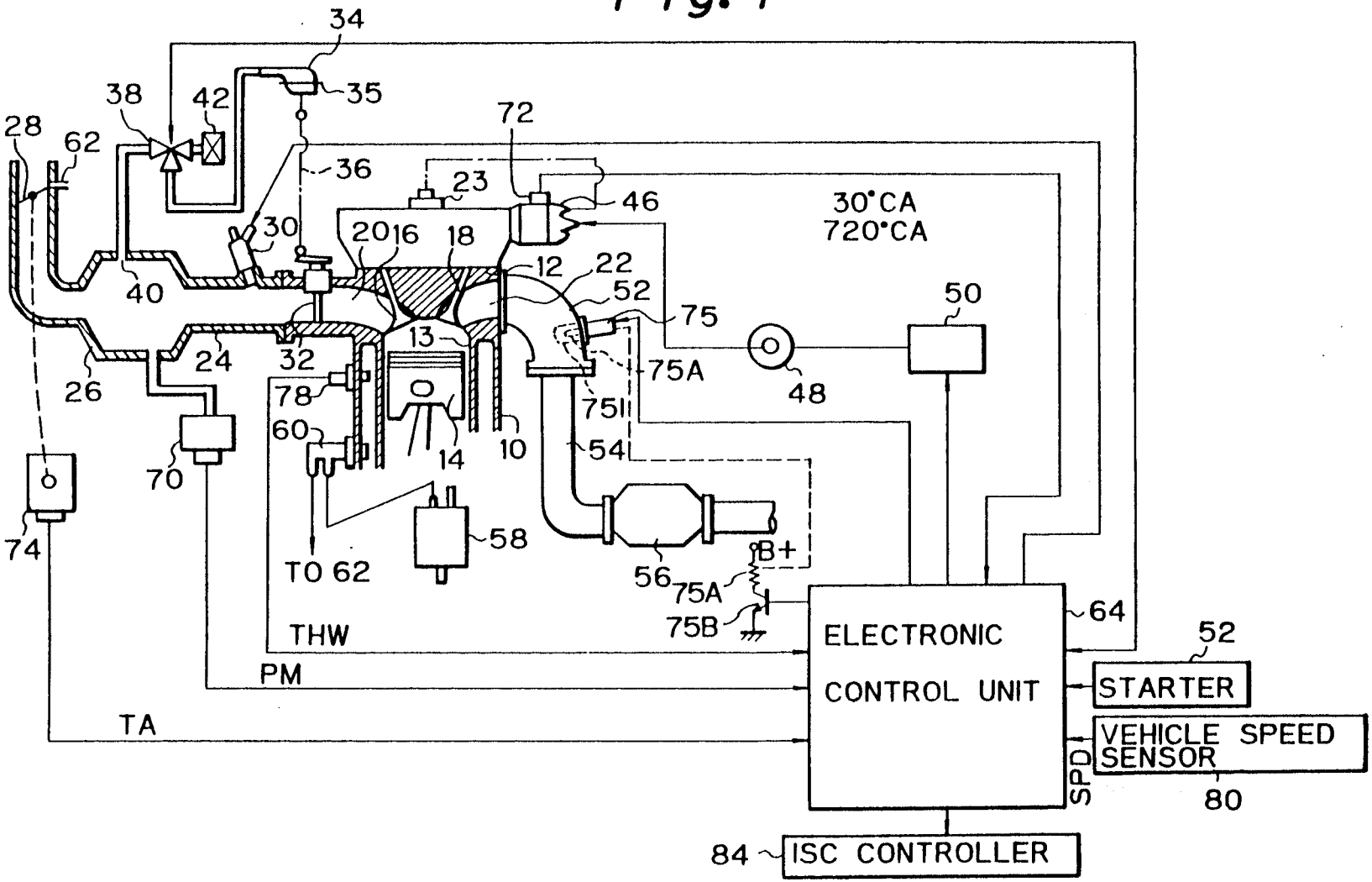
FIG. 1 is a schematic general view of a lean burn internal combustion engine according to the present invention.

FIG. 1 shows an electronic controlled fuel injection type, internal combustion engine, wherein reference numeral 10 denotes a cylinder block, 12 a cylinder head, 13 a cylinder bore, 14 a piston, 16 an intake valve, 18 an exhaust valve, 20 an intake port, 22 an exhaust port, and 23 a spark plug. The intake port 20 is connected to an intake manifold 24 and to a surge tank 26, which is connected to a throttle valve 28 for controlling the amount of intake air. A fuel injector 30 is connected to the intake manifold 24, for introducing an amount of fuel into the intake manifold 24. A swirl control valve (SCV) 32 is arranged in the intake port 20 to partially close or open the intake port 20 in a manner well known to those skilled in this art. When the SCV 32 is closed, a swirl motion of the air-fuel mixture is created when it is introduced into the cylinder bore 13, which allows the air-fuel mixture to be burnt if it is very lean. When the SCV 32 is open, a relatively straight flow of the air-fuel mixture is obtained and is adapted for a combustion of an air-fuel mixture other than a super lean mixture.

The SCV 32 is connected to a vacuum type actuator 34 having a diaphragm 35 connected to the SCV 32 via a connecting member such as a rod. A three port electromagnetic valve is provided as a vacuum switching valve (VSV) 38. The VSV 38 is switched between a first position at which the diaphragm 35 is opened to a vacuum port 40 in the surge tank 26, so that the vacuum pressure in the surge tank 26 causes the diaphragm 35 to be displaced and the SCV 32 to be closed, to thereby obtain the swirl motion allowing the super lean air-fuel mixture to be stably burnt, and a second position at which the diaphragm 35 is opened to the atmospheric pressure via an air filter 42, so that the atmospheric pressure causes the diaphragm 34 to be returned to the original position and the SCV 32 to be opened to obtain a straight flow, to thereby obtain the required air-fuel ratio for the desired output power of the engine.

Reference numeral 46 denotes a distributor connected to an ignition coil 48 operated by a ignitor 50. The distributor 46 is, as well known, selectively connected to the spark plugs 23 of the respective cylinders.

The exhaust port 22 is connected to a exhaust manifold 52, which is connected to an exhaust pipe 54 and a catalytic convertor 56.

A charcoal canister 58 is used for temporarily storing vaporized fuel from a fuel tank, and for re-introducing the fuel into the engine. A purge control valve 60 is mounted on the cylinder block 10 and responds to a temperature of the engine cooling water for introducing the stored fuel in the canister 58 into the intake line at a purge port 62 located upstream of the throttle valve 28 in the idle position.

An electronic control unit 64 is constructed as a microcomputer which is responsive to various signals from sensors controlling the fuel injectors 30, to thereby control the air-fuel ratio, the ignitor 50 for controlling the ignition timing, the vacuum switching valve (VSV) 38 for controlling the position of the swirl control valve (SCV) 32, and other engine operating units which are not explained since they are not related to the present invention. An intake pressure sensor 70 is connected to the surge tank 26 for detecting the absolute pressure PM in the surge tank 26 as an indication of the engine load. A crank angle sensor 72 is connected to the distributor 46 for obtaining pulse signals at every 30 degrees and 720 degrees of crankshaft angle (CA) of the engine. The 30 degree CA signal is used to calculate the engine speed NE, as is well known, and the 720 degree CA signal is used as a reference signal for one complete cycle of the engine. A throttle sensor 74 is connected to the throttle valve 28 for detecting the degree of opening of the throttle valve 28. The throttle sensor 74 is provided with a VL switch which is made ON or OFF at a predetermined degree y of the throttle valve 28, above which the air-fuel ratio is controlled to a power air-fuel ratio which is equal to, for example, 13.5, in this embodiment. A lean type air-fuel ratio sensor 75 is arranged on the exhaust manifold 52 for detecting the air-fuel ratio of the combustible mixture introduced into the engine. An engine cooling water temperature sensor 78 is connected to the cylinder block 10 and is in contact with the engine cooling water to detect the temperature THW, and a vehicle speed sensor 80 detects the vehicle speed SPD. A starter 82 and a well known idle speed controller 84 are connected to the control unit 64.

The lean sensor 75 is, as is well known, provided with a heater 75A arranged adjacent to a detecting element 751 made of a solid electrolyte material, such as zirconia. The heater 75A is electrically connected to a power supply B+ at one end, and to a transistor 75B at the other end for selectively energizing the heater 75A to obtain a desired temperature of the detecting element.

Figure 2:
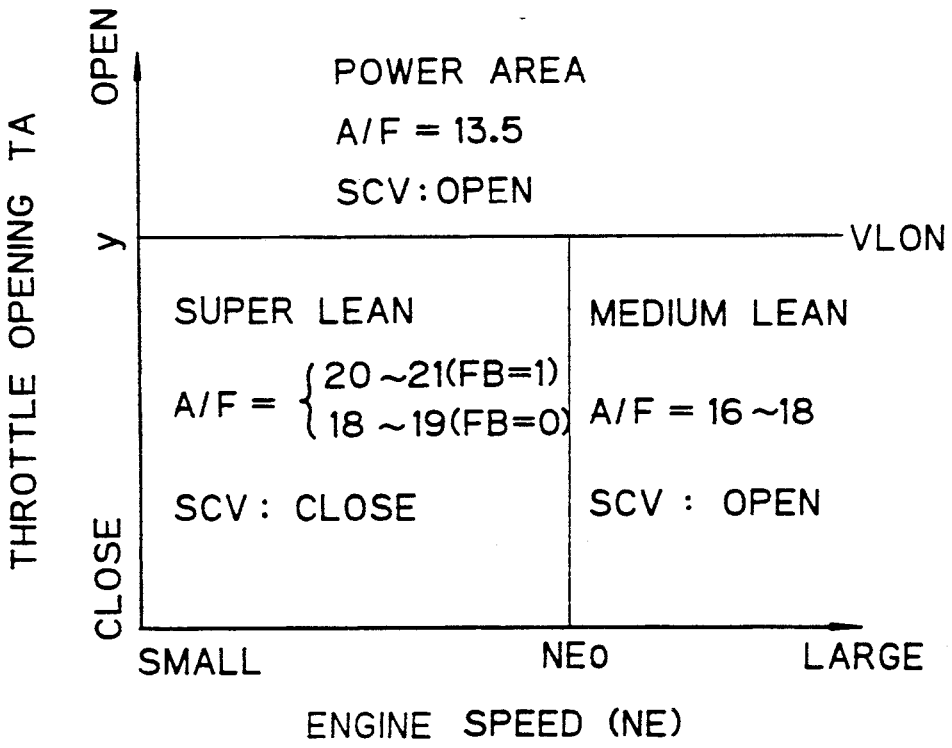
FIG. 2 shows a map of the engine speed and throttle opening and illustrates how the air-fuel ratio is determined.

FIG. 2 is a schematic diagram of a map indicating how the air-fuel ratio and the swirl control valve 32 are controlled with respect to combinations of the values of the engine speed NE and the degree of throttle opening TA. A lean air-fuel mixture is obtained in the area where the degree of throttle opening TA is smaller than the predetermined value y, which corresponds to a point at which the VL switch in the throttle sensor 74 is made ON or OFF. The lean zone is divided into two zones; a super lean zone and a medium lean zone. The super lean zone is obtained at an engine speed NE smaller than the predetermined value $NE_0$, where the air-fuel ratio is, for example, between 20 to 21, when an air-fuel ratio feedback operation is carried out (FB=1), and is, for example, between 18–19, when the air-fuel ratio feedback operation is not carried out (FB=0). Under the super lean condition, the SCV (swirl control valve) 32 is closed, to thereby obtain the swirl movement of the air-fuel mixture in the cylinder bore 13. The medium lean zone is obtained under an engine speed NE higher than the predetermined value $NE_0$, where the air-fuel ratio is, for example, between 16 to 18. The feedback control of the air-fuel ratio is not carried out in the medium lean zone, and the SCV 32 is opened to increase the intake efficiency.

A power air-fuel ratio area is obtained when the degree of throttle opening TA is larger than the predetermined value y. Under this power air-fuel ratio area, the air-fuel ratio is controlled to a value such a as 13.5, which is smaller than the theoretical air-fuel ratio value, and the SCV 32 is opened.

In a lean burn internal combustion engine, the fuel injection amount is calculated from a basic fuel amount for obtaining a stoichiometric air-fuel ratio, to which basic amount a lean correction factor of a value of less than 1.0 is multiplied so that a lean air-fuel mixture of air-fuel ratio higher than the stoichiometric air-fuel ratio is obtained. As is well known, a map KAF of the values of the lean correction factor with respect to the combinations of values of the engine speed and engine load parameter, such as the intake absolute pressure PM, is provided, and a map interpolation calculation is carried out to obtain a value of the lean correction factor corresponding to detected combinations of values of the engine speed and intake pressure.

Figure 3A:
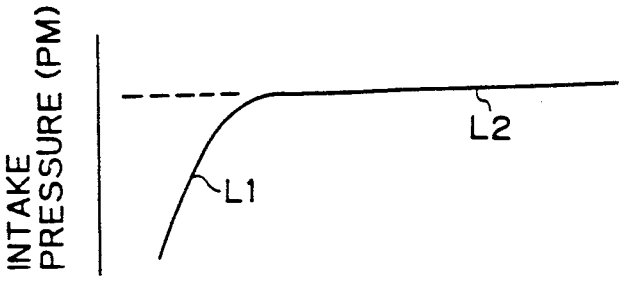
FIG. 3 (a) to (c) show changes in the intake pressure, air-fuel ratio, and engine torque, respectively, with respect to the degree of opening of the throttle valve.
Figure 3B:
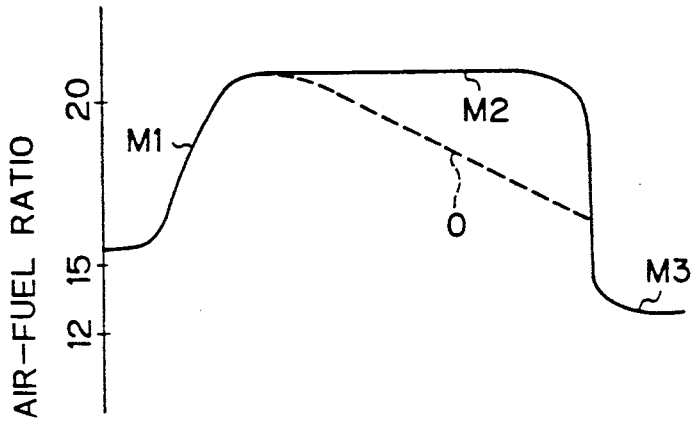
Figure 3C:
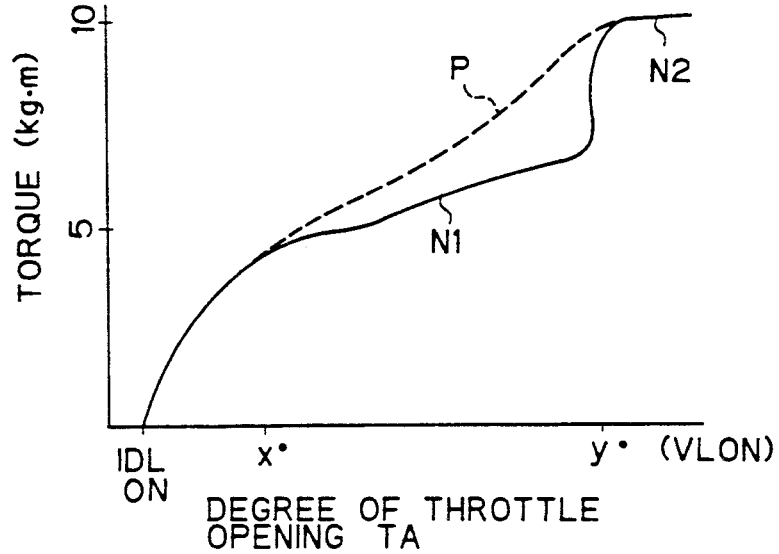

The calculation of the lean correction factor based on the intake pressure is used for executing a precise control of a desired air-fuel ratio at the low load condition and a small degree of throttle opening, where a super lean combustion of air-fuel ratio as high as, for example, 21.0, is carried out. The calculation of the lean correction factor, however, suffers from a drawback in that a smooth control of the engine torque cannot be obtained as the accelerator pedal is depressed. FIG. 3(*a*) shows a relationship between the degree of opening of the throttle valve 28 and the value of the intake pressure PM when the engine speed is maintained at a predetermined constant value. A linear and steep relationship is obtained, as shown by a curve portion L1, in a area wherein the degree of opening of the throttle valve 28 is smaller than a predetermined degree x, so that a desired lean air-fuel ratio as shown by M1 in FIG. 3(*b*) can be obtained. At the range wherein the degree of the throttle valve 28 is wider than the predetermined value x, however, the value of the intake pressure is maintained unchanged, as shown by a line L2 which corresponds to the atmospheric air pressure. As a result, the air-fuel ratio is maintained substantially unchanged in the lean zone, as shown by a line M2. When the throttle valve 28 is opened to a degree y where the VL switch is made ON, the engine enters the power area wherein an acceleration fuel enrichment correction is carried out to obtain an air-fuel ratio which is smaller than the theoretical air-fuel ratio, as shown by a line M3 in FIG. 3(*b*). A torque characteristic in the prior art lean burn engine is shown by a solid line in FIG. 3(*c*), where the engine torque is maintained as low as a line N1 when the degree of opening of the throttle valve 28 is lower than VL, and when this opening VL is obtained, the engine torque is abruptly increased as shown by a line N2, causing the driver to feel some discomfort.

In view of this drawback, according to the present invention, another lean correction factor map is provided, which has values of the lean correction factor with respect to combinations of values of the engine speed and degree of opening of the throttle valve 28, which map KAFTA is in a range wherein the degree of opening of the throttle valve is large than the predetermined value y, so that the air-fuel ratio in the range of the degree of opening of the throttle valve larger than y is reduced in accordance with the increase in the degree of opening of the throttle valve, as shown by a dotted line O in FIG. 3(*b*). As a result, a torque increase characteristic as shown by line P in FIG. 3(*c*) is obtained, which is smoothly connected to the line N2 when the engine enters the power enrichment area, thus preventing a feeling of discomfort.

Now, the operation of the electronic control unit 64 for operating the fuel injectors 30 and the three-way switching valve 38 will be described with reference to the flowcharts.

Figure 4:
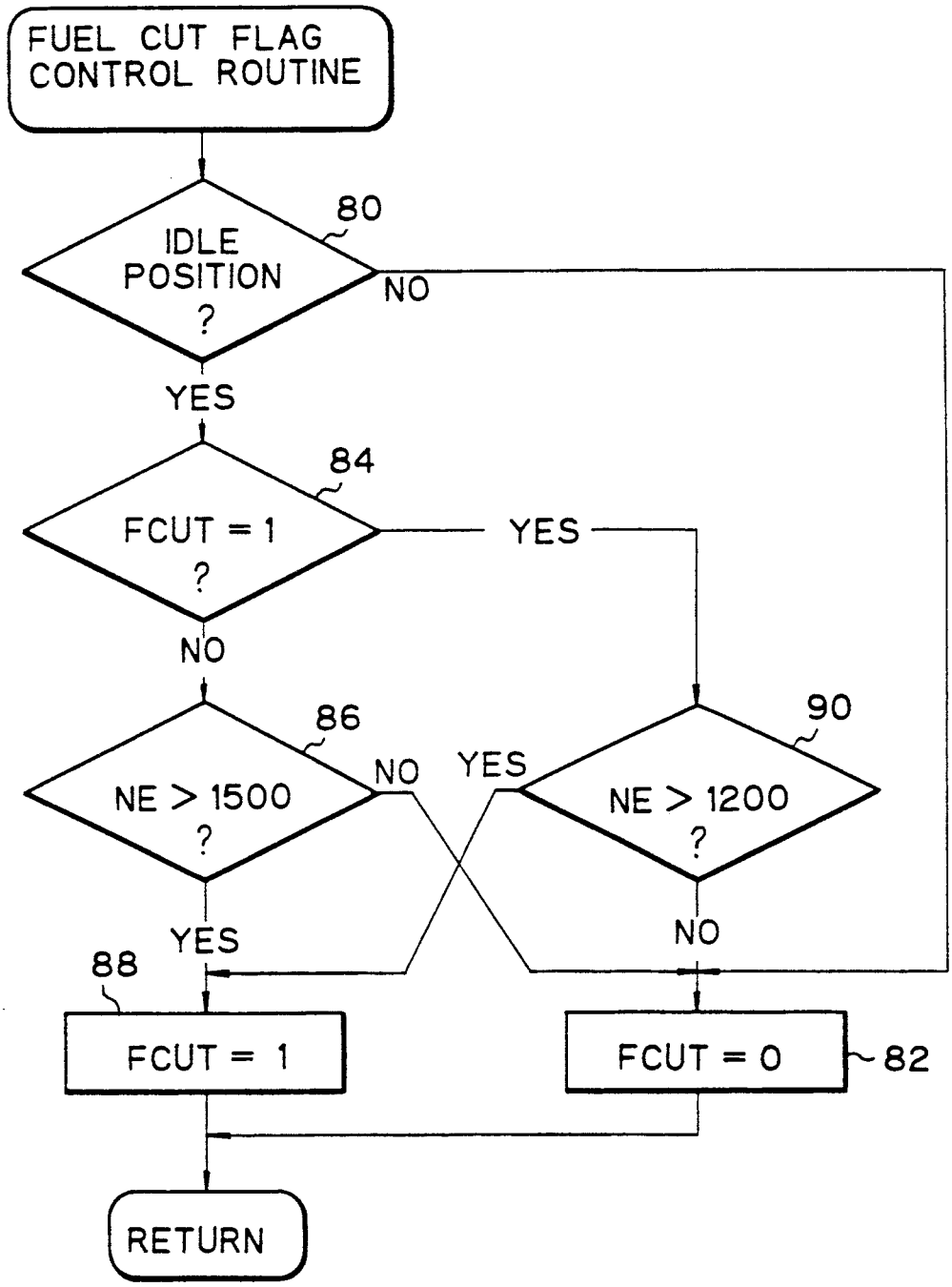
FIGS. 4 to 12 are flowcharts illustrating how the control circuit in FIG. 1 operates to control the engine.

FIG. 4 shows a fuel cut condition determination routine, which is executed at predetermined intervals. At step 80, it is determined if the idle switch of the throttle position sensor 74 has been made ON, i.e., the throttle valve 28 is in the idling position. When it is determined that the idle switch has been made OFF, the routine goes to step 82, where the fuel cut flag FC is cleared (0).

When it is determined that the idling switch has been made ON, the routine goes to step 84 and it is determined if the fuel cut flag FC is set (1). When the FC=0, i.e., a fuel cut operation is not carried out during the time when this routine is carried out, at the preceding routine, the routine goes to step 86, where it is determined if the engine speed NE is larger than a predetermined value, such as 1500 r.p.m. When NE>1500, this means that the engine is decelerated from a condition wherein the engine speed is higher than 1500. The routine then goes to step 88, where the fuel cut flag FC is set (1), and therefore, a fuel cut operation is carried out as described later. When the engine speed is not larger than 1500, the routine goes from step 86 to step 82, and flag FCUT remains cleared.

When it is determined that FCUT=1, the routine goes to step 90 where it is determined whether the engine speed is higher than 1200 r.p.m. When the engine speed is larger than 1200 under the fuel cut condition, the routine goes to step 88 to maintain the flag FCUT in the set state. When the engine speed becomes lower than 1200, the routine goes to step 82 to clear the flag FCUT and stop the fuel cut operation.

Figure 5:
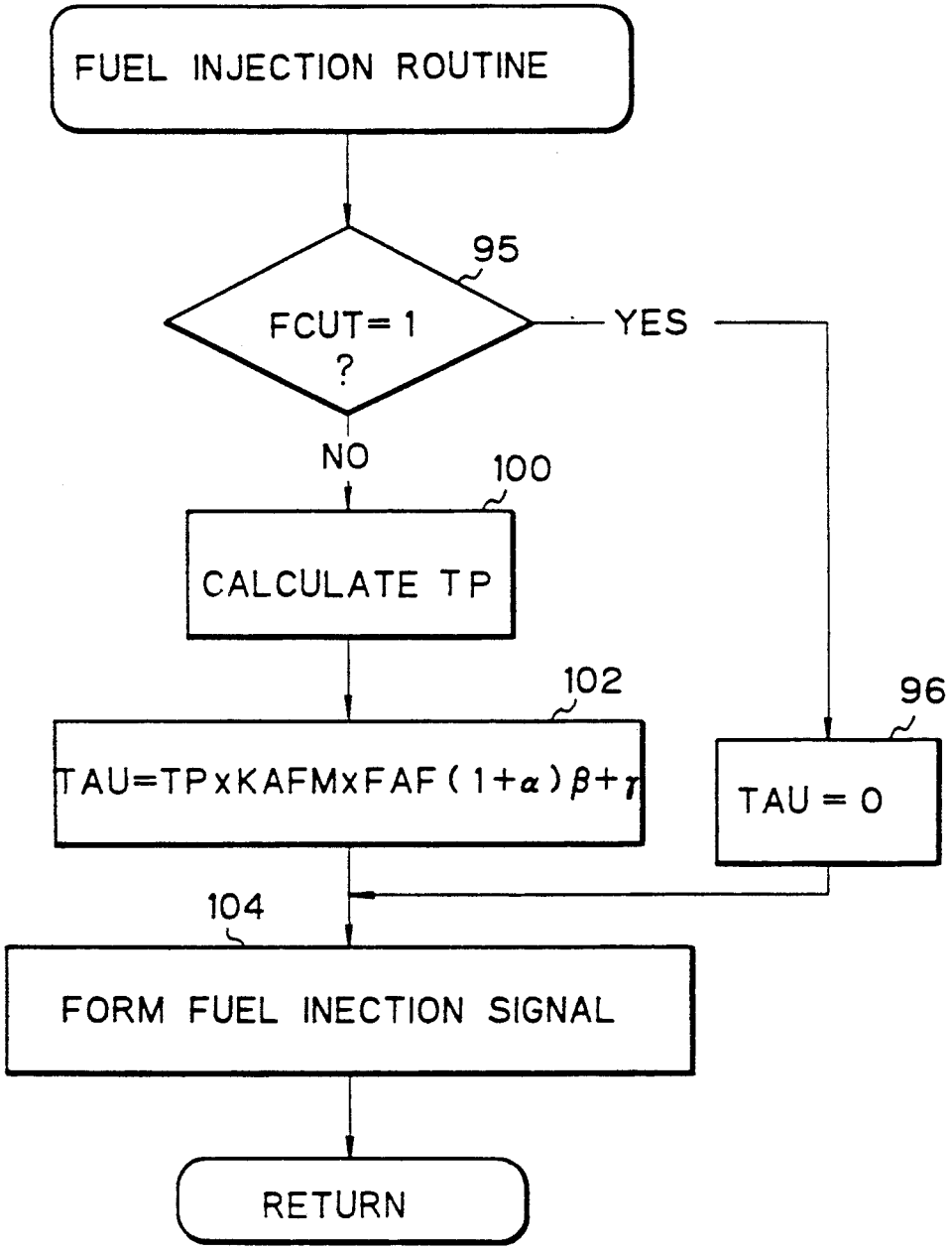

FIG. 5 is a fuel injection routine carried out at the timing of each fuel injection by the respective fuel injectors 30. This timing is obtained for every 180 degrees CA for a four cylinder engine, and can be detected by the number of the counter which is incremented at each input of a 30 degree CA signal from the crank angle sensor 72 and cleared at each input of a 720 degree CA signal from the sensor 72, as is well known. At step 95, it is determined if the fuel cut flag FCUT=1. When FCUT=1, the routine goes to step 96, where zero is moved into TAU, for carrying out the fuel cut operation. When FCUT=0, the routine goes to step 100 and a calculation of a basic fuel injection amount TP is carried out, which corresponds to an amount of fuel needed for obtaining a theoretical air-fuel ratio for the intake pressure and the engine speed at this stage. A map of the values of the basic fuel injection amount with respect to combinations of values of the intake pressure PM and the engine speed NE is provided, and a well known map interpolation calculation is carried out to obtain a value of a basic fuel injection amount TP corresponding to the detected PM and NE values.

At step 102, a fuel injection amount TAU is calculated by $$TAU = TP \times KAFM \times FAF(1+\alpha)\beta + \gamma,$$

where KAFM is an air-fuel ratio correction factor an FAF is a feedback correction factor, and $\alpha$, $\beta$ and $\gamma$ indicate well-known correction factors or correction amounts used for correcting the fuel injection amount, which are not explained here because they are not closely related to the present invention.

At step 104, a fuel injection signal to be supplied to the fuel injector 30 of a designated cylinder is formed, and thus a fuel injection of the amount TAU calculated at the step 102 is carried out.

Figure 6:
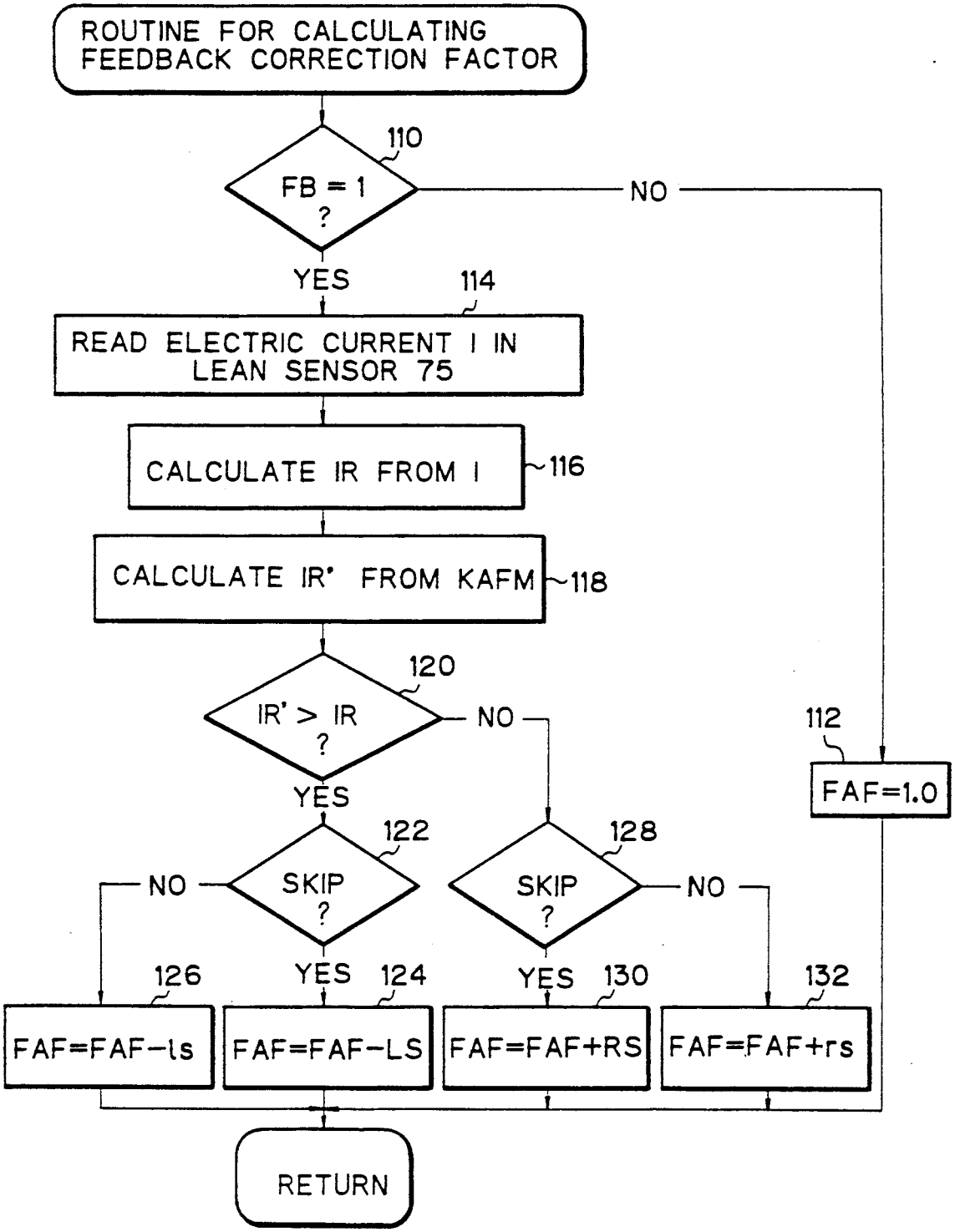

FIG. 6 illustrates a routine flowchart for calculating the feedback correction factor FAF used at step 102 is FIG. 5. This routine is carried out at predetermined internals of, for example, 4 milliseconds. At step 110, it is determined if a feedback flag FB is set. This flag Fb is set (1) when the air-fuel ratio feedback control is carried out and reset (0) when the air-fuel ratio feedback control is not carried out. When FB=0 (the air-fuel ratio feedback control is not carried out), the routine goes to step 112, where the FAF is given a value of 1.0.

When FB=1 (the air-fuel ratio feedback control is carried out), the routine goes to step 114 where an electric current I in the lean sensor 75 is input. At the following step 116, a calculation is made of convert the detected electric value I to a corrected value IR which corresponds to the air-fuel ratio of the combustible mixture introduced into the engine. A map of IR values with respect to the I values is stored in the memory, and a map interpolation calculation is carried out to obtain a value of the IR corresponding to the detected electric current I. At step 118, a reference value IR' as a target air-fuel ratio is calculated from the air-fuel ratio correction factor KAFM. As described later, when the feedback control of the air-fuel ratio is carried out, the KAFM is given a value smaller than 1.0 for obtaining a lean air-fuel mixture. At step 120, it is determined if the IR' as the target air-fuel ratio is larger the IR as the actual air-fuel ratio. When IR' is larger than IR' i.e., the air-fuel ratio should be controlled so that air-fuel ratio is increased, the routine goes to step 122 where the first determination of IR'≦IR is obtained at step 120, i.e., a skip control is carried out. If the result of the determination is YES, the routine goes to step 124, where the feedback correction factor FAF is decremented for an LS value, which causes a lean skip correction. When a result of NO is obtained at step 122, the routine goes to step 126 where the feedback correction factor FAF is decremented for 1s(<LS); this is called an integration correction.

When it is determined at step 120 that IR' is not larger than IR, i.e., the air-fuel ratio should be controlled so that it is decreased, the routine goes to a step 128 and is determined if the first determination of IR'≦IR was obtained at step 120, i.e., a skip control should be carried out. If the result of the determination is YES, the routine goes to step 130, where the feedback correction factor FAF is incremented for an RS value; this is a rich skip correction. When a result of NO is obtained at step 128, i.e., the determination of IR'>IR is not the first one at step 120, the routine goes to step 132 where the feedback correction factor FAF is incremented for rs(<RS); this is an integration correction. As a result of the above feedback control operation, the air-fuel ratio is controlled to the target air-fuel ratio.

Figure 7:
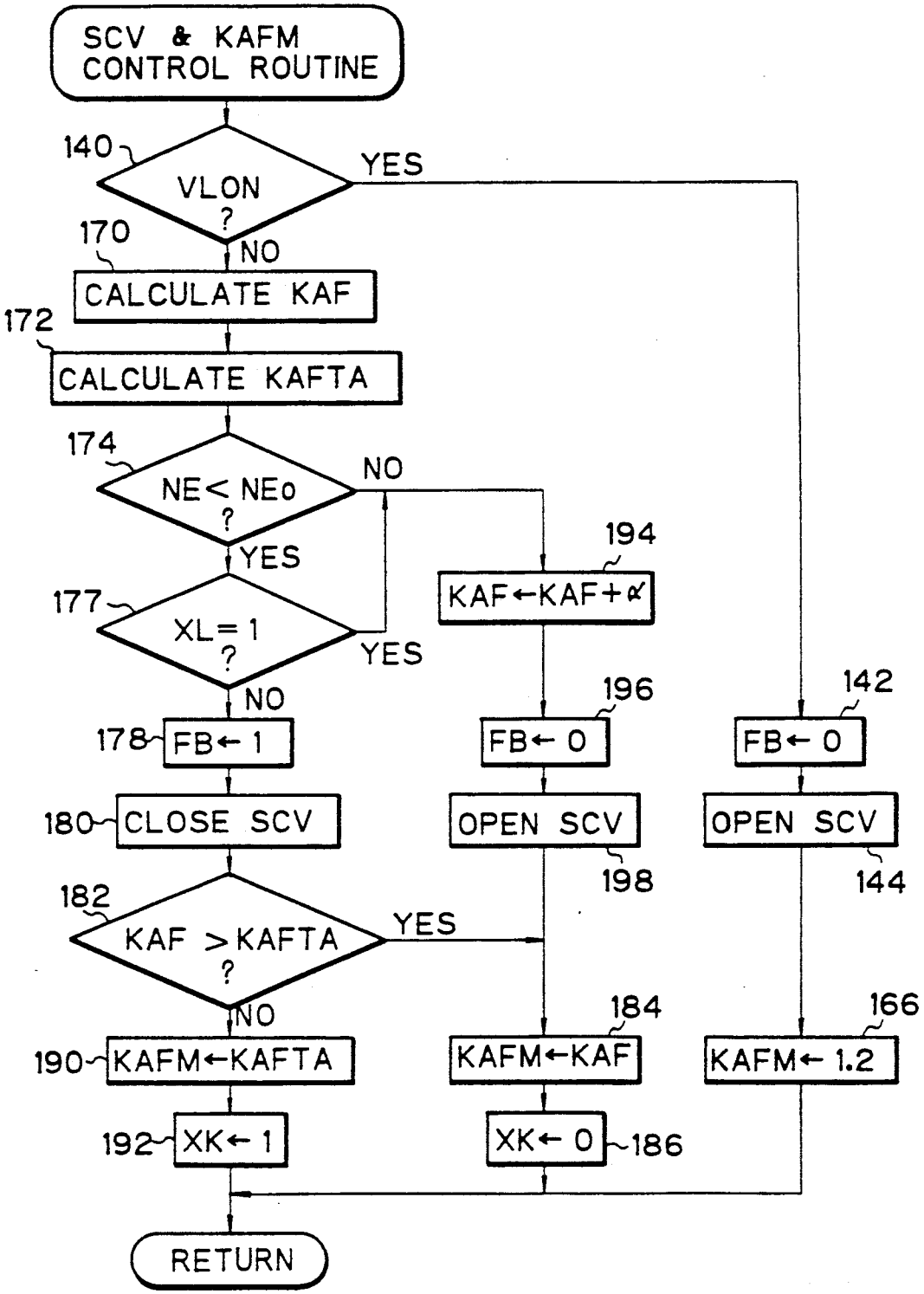

FIG. 7 shows a routine for controlling the swirl control valve (SCV) and the air-fuel ratio correction factor KAFM. This routine is executed at predetermined intervals of, for example, 4 milliseconds. At step 140, it is determined if the VL switch in the throttle sensor 74 is ON, i.e., the degree of the throttle valve 28 is, as shown in FIG. 2, larger than the predetermined degree of opening y. When the VL switch is ON, i.e., the engine is in the power area wherein the throttle opening is larger than y, the routine goes to step 142 and the feedback flag FB is cleared (0) so that the air-fuel ratio feedback control is stopped, as realized at the step 112 in FIG. 6. At the following step 144, a signal is issued to the three way valve 38 so that it is located at a position whereat the atmospheric pressure is opened to the diaphragm 35 of the actuator 34, and thus the SCV 32 is open and a straight air flow into the cylinder bore 13 is obtained and adapted for the power mode of the engine. At the following step 166, a value, for example, 1.2, is moved to the air-fuel ratio correction factor KAFM, whereby a rich air-fuel mixture having an air-fuel ratio value such as 13.5 is obtained, as shown in FIG. 2.

It is determined at step 140 if the VL switch is OFF, i.e., the degree of throttle valve 28 is smaller than the predetermined degree of opening y. When the VL switch is OFF, i.e., the degree of opening of the throttle valve 28 is smaller than the predetermined degree of opening y, the routine goes to step 170, where a map interpolation calculation of an intake pressure based lean correction factor KAF is carried out. This map is used for obtaining the lean air-fuel mixture at the lean combustion area wherein the value of the intake pressure PM can change linearly, as shown by the line L1 in FIG. 3(*a*), as the accelerator pedal is depressed, which corresponds to the range of the degree of opening of the throttle valve 28 smaller than x. This map is constructed by KAF values with respect to combinations of the values of the engine speed NE and the intake pressure PM, and this KAF map is constructed, for example, as follows.

| | NE (R.P.M.) | | | | |
|---|---|---|---|---|---|
| PM (mmHg) | 600 | 800 | 1000 | 1200 | . . . |
| 211 | 0.75 | 0.75 | 0.75 | 0.75 | — |
| 289 | 0.625 | 0.625 | 0.625 | 0.5 | — |
| 758 | 0.5 | 0.5 | 0.5 | 0.4 | |

At step 170, a map interpolation calculation is carried out to obtain a KAF value corresponding to combination of detected values of the intake pressure PM and the engine speed NE.

At step 172, a map interpolation calculation of a throttle opening based lean correction factor KAFTA is carried out. This map is used for obtaining the lean air-fuel ratio mixture at the lean combustion area wherein the value of the intake pressure PM is unchanged as shown by the line L2 in FIG. 3(*a*), regardless of the amount of depression of the accelerator pedal, and corresponds to the range of the degree of opening of the throttle valve 28 of between x and y. This map is constructed by KAFTA values with respect to the combinations of values of the engine speed NE and the throttle opening TA, and this KAFTA map is constructed, for example, as follows.

| | NE (R.P.M.) | | | | |
|---|---|---|---|---|---|
| TA (degree) | 600 | 800 | 1000 | 1200 | . . . |
| 39 | 0.55 | 0.55 | 0.55 | . | . |
| 46 | 0.7 | 0.7 | . | . | . |
| 55 | 0.9 | . | . | . | . |

-continued

| TA (degree) | NE (R.P.M.) 600 | 800 | 1000 | 1200 | ... |
|---|---|---|---|---|---|
| . | . | . | . | . | . |
| . | . | . | . | . | . |
| . | . | . | . | . | . |

It should be noted that the values of the lean values of correction factor in the map FAFTA are determined such that, at the area of the throttle valve opening smaller than the predetermined value x, the FAFTA values are smaller than the corresponding values of the correction factor in the map FAF, which allows the map FAF having a higher air-fuel ratio correction value to be selected at this area (YES result at step 182), and such that, at the area of the throttle valve opening larger than the predetermined value x, the FAFTA value is larger than the corresponding values of the correction factor in the map FAF, which allows the map FAFTA to be selected in this area (NO result at step 182).

At step 172, a map interpolation calculation is carried out to obtain a KAFTA value corresponding to a combination of detected value of the throttle opening TA and the engine speed NE.

At step 174, it is determined if the engine speed NE is smaller than the predetermined value $NE_0$. When the engine speed $NE<NE_0$, i.e., a feedback condition is obtained, the routine goes to step 177 and it is determined if a feedback prohibiting flag XL is set. As fully described later, this flag is set when an engine high speed state is continued for longer than a predetermined time, and is cleared upon a lapse of a predetermined time after the high engine speed condition is cancelled. When it is determined that XL=0, the routine goes to step 178, where the air-fuel ratio feedback control flag FB is set so that air-fuel ratio feedback control is carried out (step 110 in FIG. 6). At the following step 180, a signal is issued to the three way switching valve 38 to cause it to take a position whereat the intake vacuum port 40 is connected to the diaphragm 35 of the actuator 35, so that the swirl control valve (SCV) 32 is closed to thus obtain a swirl movement of the air introduced into the cylinder bore 13, to thereby obtain a stable combustion of a super lean air-fuel mixture.

At step 182, it is determined if the value of the intake pressure based lean correction factor KAF is larger than the throttle opening based lean correction factor KAFTA. When it is determined that KAF>KAFTA, which will occur when the degree of opening of the throttle valve is smaller than x in FIG. 3, the routine goes to step 184 and the value of the KAF is moved to the KAFM. At the following step 186, a flag XK is reset (0), which shows that the intake pressure based map KAF is selected for calculating the air-fuel ratio correction factor KAFM.

When it is determined that KAF≦KAFTA, which will occur when the degree of opening of the throttle valve is larger than x in FIG. 3, the routine goes to step 190 and the KAFTA value is moved to KAFM. At the following step 192, a flag XK is set (1), which shows that the throttle opening base map KAFTA is selected for calculating the air-fuel ratio correction factor KAFM, to obtain a super lean air-fuel mixture.

These steps 182 to 192 are used for selecting the map KAF or KAFTA which obtains a higher value. Namely, when the degree of opening of the throttle valve 28 is smaller than x, the map KAF is selected for controlling the air-fuel ratio, which is changed as shown by the line M1 and M2 in FIG. 3(*b*), and when the degree of opening of the throttle valve is larger than x, the map FAFTA is selected for calculating the air-fuel ratio correction factor KAFM, to obtain a lean air-fuel mixture as shown by the line O in FIG. 3(*b*), which is less lean than that obtained if the map KAF is selected.

When it is determined at step 174 that $NE \leqq NE_0$, i.e., the engine is in a non-feedback condition, or when it is determined at step 177 that XL=1, i.e., the feedback control is prohibited, the routine goes to step 194 and the KAF value is increased by a value $\alpha$, which is used for obtaining a less lean air-fuel mixture in the zone of the engine speed $NE \leqq NE_0$, and the feedback control is stopped (FB=0) as shown in FIG. 2. At step 196, the feedback control flag FB is cleared, and at step 198, a signal is issued to the three way switching valve 38 to cause the valve 38 to assume a position whereat the atmospheric pressure is applied to the diaphragm 35, to open the SCV 32, and then goes to step 184.

The present invention is further provided with a heating system for controlling an electric current in the heater 75A of the lean sensor 75, to obtain a desired temperature of the sensing element thereof. This is used for obtaining a desired constant relationship between the output level from the sensor 75 and the air-fuel ratio of the air-fuel mixture, to thereby obtain a desired control of the air-fuel ratio. In this heater system, the electric current is basically map-controlled in accordance with the engine speed and intake pressure, as the engine load parameter, in such a manner that, as the engine speed and/or engine load increases, the lower becomes the heater electric power, and as the engine speed and/or engine load decreases, the higher becomes the heater power. Such a control of the heater power is used for compensating the effect of the exhaust gas temperature, which increases as the engine speed or engine torque increases, or for preventing an overheating of the element, which would cause the element to be damaged.

Nevertheless, several factors will cause the temperature of the sensing element of the lean sensor to be varied from that designated by the map, and according to the present invention, a means is provided for controlling the heater power, to thereby compensate for these factors and obtain a desired sensing element temperature, thus preventing damage thereto.

Figure 8:
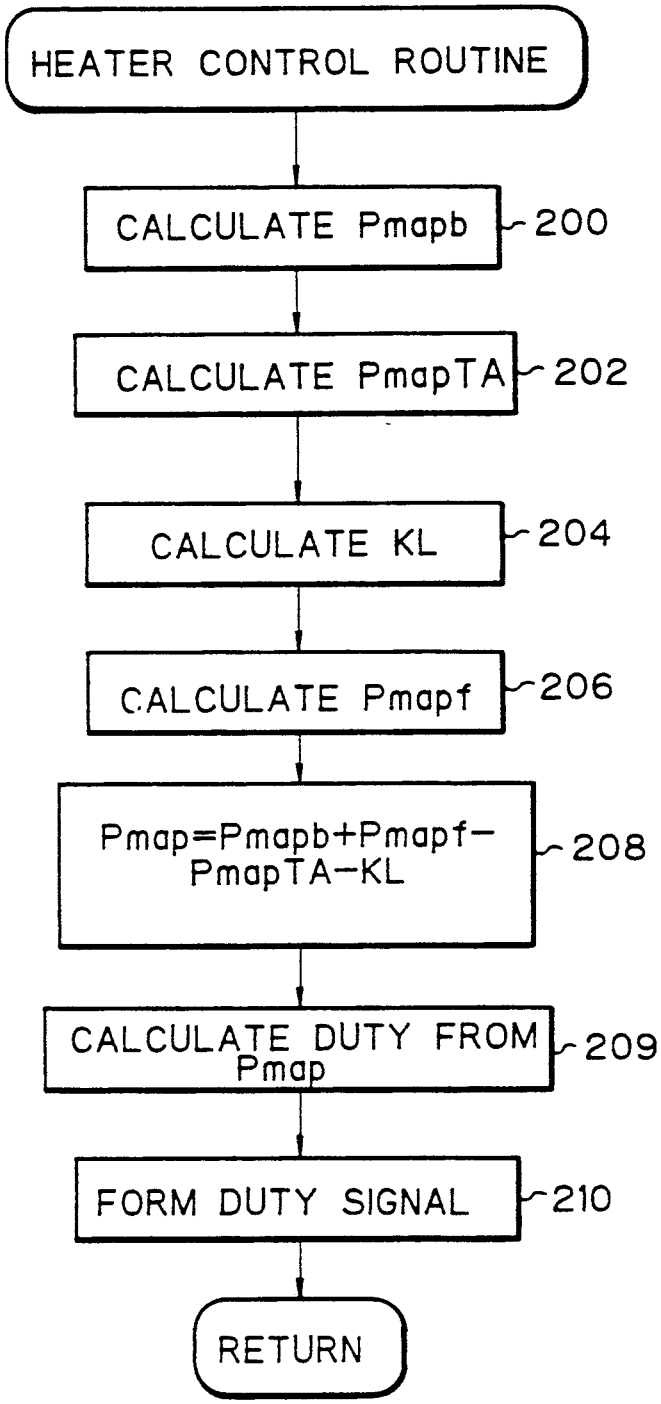

FIG. 8 shows a routine for controlling an electric current in the heater 75A of the lean sensor 75. This routine is carried at predetermined intervals of, for example, 2 milliseconds. At step 200, a map interpolation calculation is carried out to obtain a basic electric current Pmapb, which basically obtains a desired electric current of the heater to thereby obtain a desired temperature of the sensing element at a certain engine state determined by the engine speed and load values. A map of values of the basic electric current is provided with respect to combinations of the values of the engine speed and intake pressure. This map of Pmapb values (watt) is, for example, constructed as shown in the following table.

| PM (mmHg) | NE (R.P.M.) 600 | 800 | 4800 | 1200 | ... |
|---|---|---|---|---|---|
| 211 | 26.2 | 26.2 | 13.3 | 9.8 | . |

-continued

| PM (mmHg) | NE (R.P.M.) 600 | 800 | 4800 | 1200 | ... |
|---|---|---|---|---|---|
| 289 | 26.2 | 26.2 | 0.6 | 0.5 | . |
| | . | . | . | . | . |
| | . | . | . | . | . |
| | . | . | . | . | . |
| 681 | 26.2 | 25.3 | 7.8 | 0 | . |
| 758 | 26.2 | 25.3 | 4.7 | 0 | . |

Figure 13:
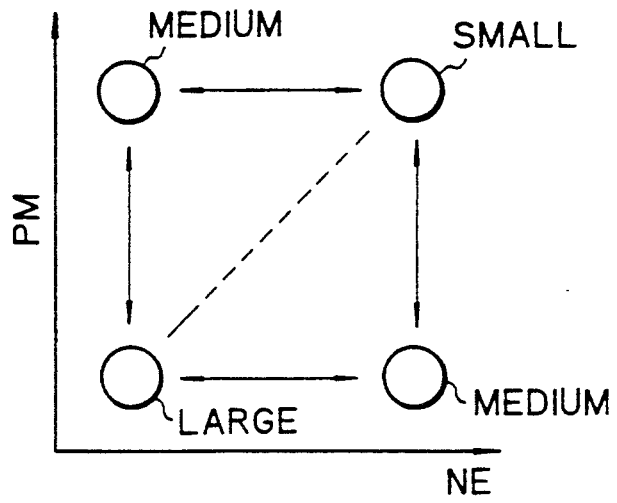
FIGS. 13(*a*) and (*b*) show how the heater power and sensing element temperature, respectively, change in accordance with the engine speed and the intake pressure.
Figure 13:
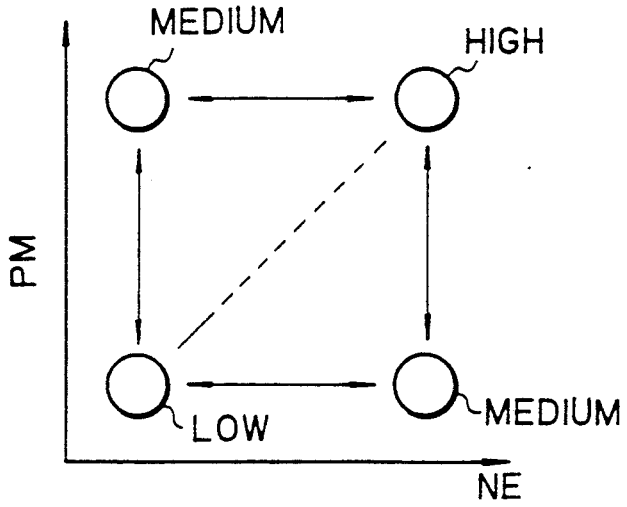

FIG. 13(*a*) schematically illustrates how the electric power of the heater is map-controlled in accordance with the engine speed NE and intake pressure PM. As is clear, the larger the engine speed or intake pressure, the smaller the heater electric power. FIG. 13(*b*) schematically shows how the temperature of the sensor element by the exhaust gas is varied in accordance with the engine speed NE and intake pressure PM. As is clear, the larger the engine speed or intake pressure, the higher the temperature of the sensor element. The map in FIG. 13(*a*) can be used to compensate for changes of the temperature characteristic of the sensor element due to the exhaust gas, to obtain a desired range of the actual temperature.

A well known map interpolation calculation is carried out at step 200 in FIG. 8, to obtain a Pmapb value corresponding to a combination of detected values of the engine speed NE and intake pressure PM.

Figure 14:
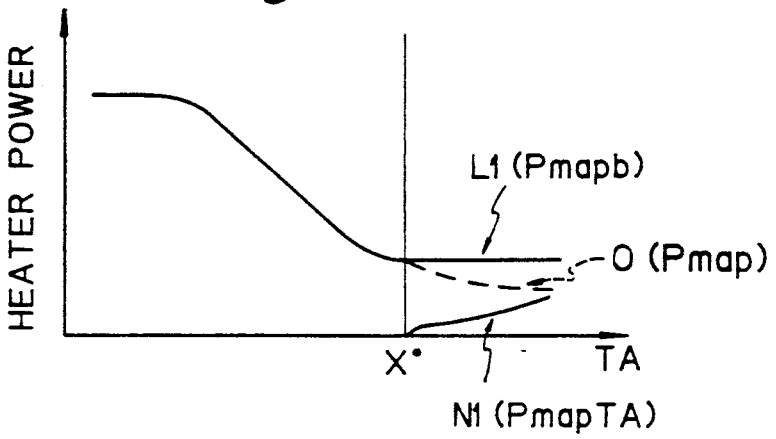
FIGS. 14(*a*) and (*b*) show how the heater power and sensor temperature change in accordance with the throttle opening.
Figure 14:
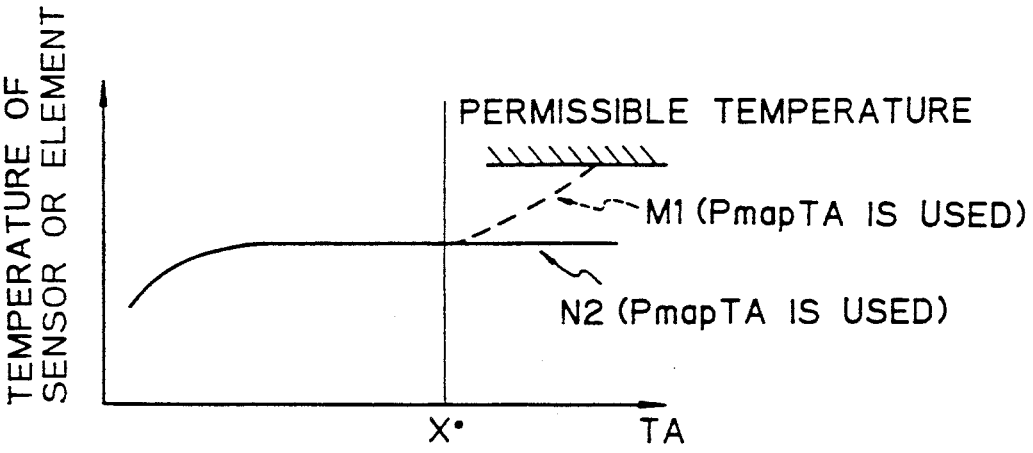

In FIG. 8, step 202 indicates a process for obtaining a correction value PmapTA. This correction value is used for lowering the heater electric power when the map KAFTA is selected (step 190 in FIG. 7) for controlling the air-fuel ratio. When the map KAFTA is selected, a less lean air-fuel mixture is obtained than that obtained if the usual map KAF is selected (step 184 in FIG. 7) and this less lean air-fuel mixture causes the temperature of the exhaust gas to be increased to a value higher than the desired limit. A line L1 in FIG. 14(*a*) shows a relationship between the degree of opening TA of the throttle valve 28 and the heater power controlled by the basic map Pmapb in FIG. 13(*a*). A line M1 shows a relationship between the TA and the temperature of the sensor element. As is clear, the temperature of the element begins to increase to the upper limit value when the degree of opening TA of the throttle valve 28 exceeds the value x in FIG. 3, where the lean correction factor map is switched from KAF to KAFTA (step 182 in FIG. 7). A line N1 shows how the value of the correction amount PmapTA changes in accordance with the TA, which is subtracted from Pmapb, as described later, to obtain a characteristic of the lowering of the heater power Pmap as finally calculated, and thus the sensor temperature is maintained substantially unchanged, as shown by a line N2 in FIG. 14(*b*).

Figure 9:
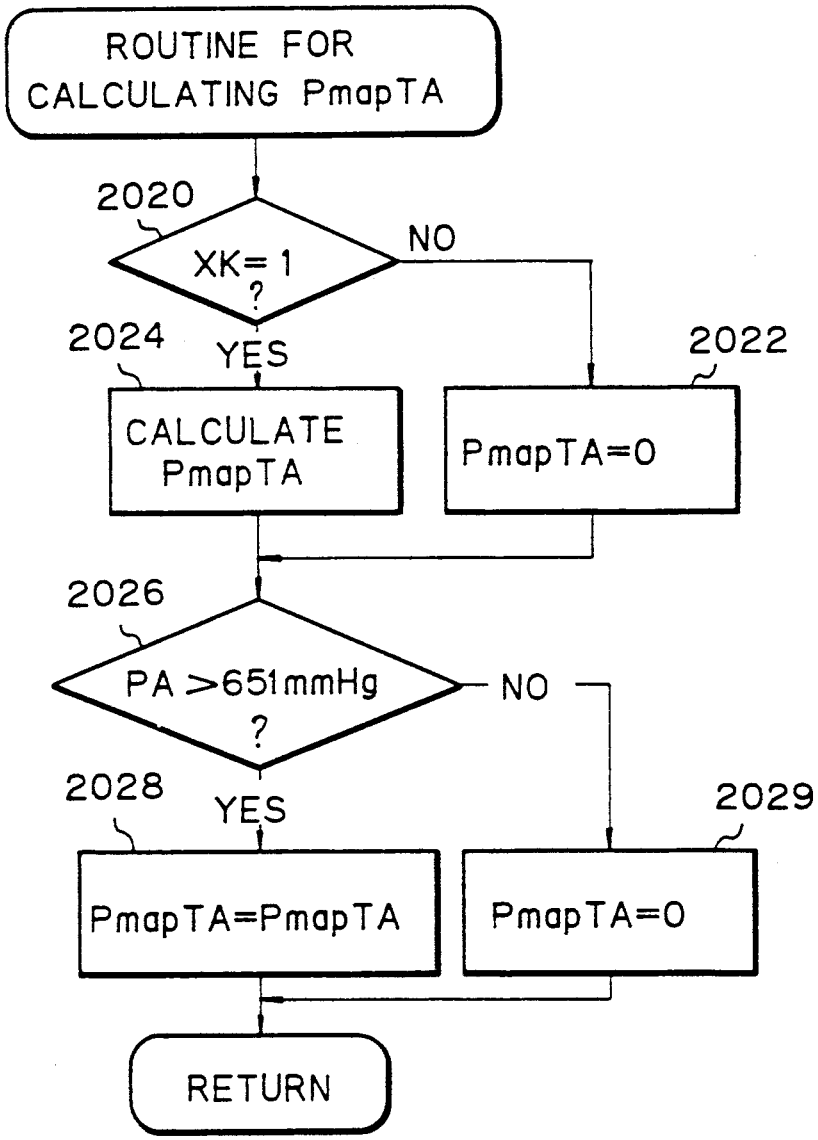

FIG. 9 shows the details of the step 202 in FIG. 8 for calculating the correction amount PmapTA. At step 2020, it is determined if the flag XK is set. This flag is set (1) when the map KAFTA for calculating the lean factor is employed (step 192 in FIG. 7), and reset (0) when the map KAF is selected (step 186 in FIG. 7). When it is determined that XK=0, i.e., the usual NE-PM map KAF is selected, the routine goes to step 2022 and zero is moved into PmapTA so that throttle valve map correction to the basic heater current map is cancelled, since the map for the calculation lean correction factor is not the map KAFTA but the intake pressure map KAF.

When it is determined that XK=1, i.e., the map KAFTA is selected for calculating the lean factor, the routine goes to step 2024 where a map interpolation is carried out to obtain a value of a heater current correction amount PmapTA corresponding to a combination of detected values of the engine speed NE and degree of opening of the throttle valve 28. As will be described later, the PmapTA value is subtracted from the basic value of the basic heater current Pmapb, to reduce the electric current in the heater 75A of the lean sensor 75. The map of the heater power (watt) correction amount PmapTA when the lean factor map KAFTA is selected is constructed, for example, as follows.

| TA (degree) | NE (R.P.M.) 1200 | 1600 | 2000 | ... |
|---|---|---|---|---|
| 39.06 | 0 | 0.9 | 1.1 | . |
| 46.88 | 1.3 | 2.2 | 5.1 | . |
| 54.69 | 2.2 | 8.0 | 11.1 | . |
| . | . | . | . | . |
| . | . | . | . | . |
| . | . | . | . | . |

At step 2024, a map interpolation calculation is carried out to obtain a value of the heater power correction amount PmapTA corresponding to a combination of the detected values of engine speed NE and the throttle opening TA.

At the following step 2026, it is determined if the atmospheric pressure PA is larger than a predetermined value, such as 651 mmHg, by which it is determined if the vehicle is running at a high altitude. When PA>651 mmHg, i.e., the vehicle is not operating under a high land, the routine goes to step 2028 and the calculated value PmapTA is used for the correction of the heater power. When it is determined that PA≦651 mmHg, i.e., the engine is operating at a high altitude, the routine goes to step 2029 and a zero value is moved to PmapTA, to prohibit the heater current correction even when the lean correction map FAFTTA is employed. When the engine is operating at a high altitude where the atmospheric pressure is low, the temperature of the exhaust gas is lower than when the engine is operating at a low altitude. Thus, when correction PmapTA is applied to the heater power, the temperature of the sensor element may be excessively decreased, which causes the sensitivity of the lean sensor to be decreased, and accordingly, a precise control of the air-fuel ratio becomes unobtainable. Namely, this is why the heater electric current correction is prohibited when the atmospheric pressure is low.

Returning to FIG. 8, at step 204, a calculation of the heater power correction amount KL is carried out. This correction amount KL is used for lowering the heater electric power when a high speed condition of the engine is continued for a long time. When this condition is obtained, the feedback control of the air-fuel ratio is prohibited by setting the flag XL to 1, as shown in step 177 in FIG. 7.

Figure 10:
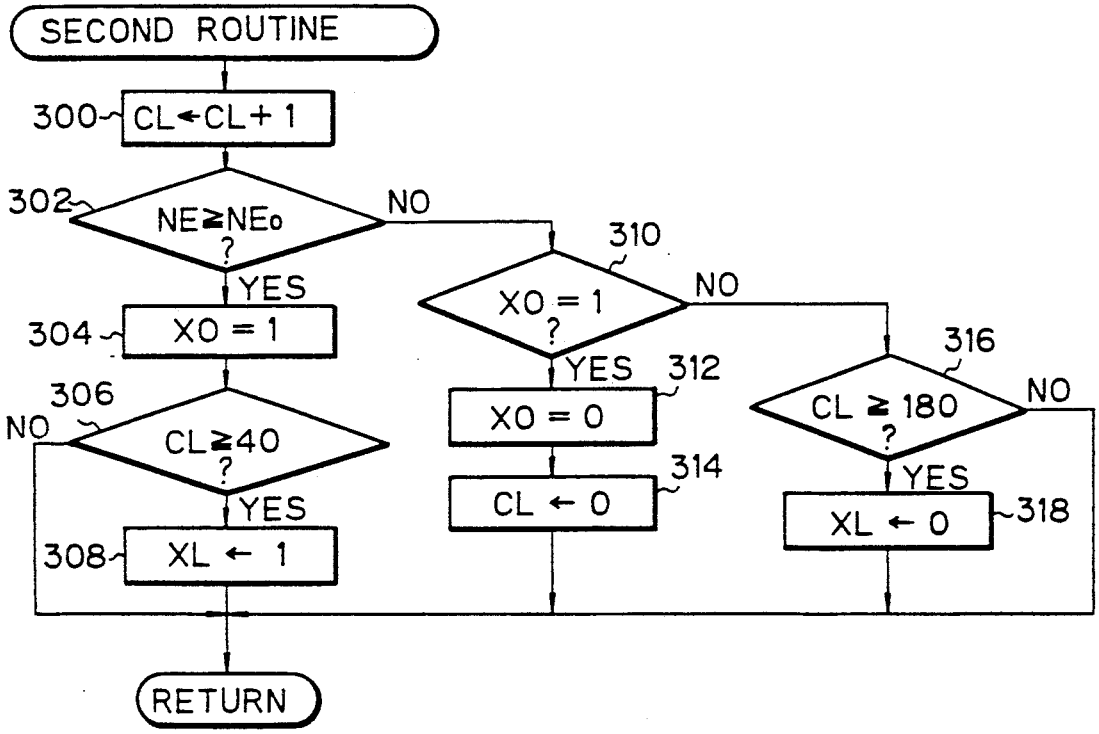

FIG. 10 is a routine for controlling the flag XL, which routine is carried out at intervals of 1 second. At step 300, a counter CL is incremented, and at step 302 it is determined whether the engine speed NE is larger than a predetermined value, such as $NE_0$ in FIG. 2. When it is determined that $NE > NE_0$, the routine goes to step 304 where a flag XO is set (1). At step 306, it is determined whether the value of the counter CL is larger than 40, i.e., the rotational speed of the engine higher than $NE_0$ is continued for longer than a period of 40 seconds. If the result of this determination is YES, the routine goes to step 308 and feedback prohibiting flag XL is set, and thus the air-fuel ratio feedback control is prohibited for a predetermined period after the engine speed becomes lower than NE (YES result at step 177).

When it is determined that the engine speed NE is smaller than $NE_0$, the routine goes to step 310 and it is determined if a flag XO=1, i.e., the engine speed is higher than $NE_0$ when the routine was carried out at the preceding timing. When the result of the determination at step 310 is YES, the routine goes to step 312 and a flag XO is cleared (0), and at step 314, a counter CL is cleared (0).

At the following timing, the routine from step 310 flows to step 316, where it is determined it CL>180, i.e., the engine speed lower than $NE_0$. is continued for longer than a time of 180 seconds. When the result of determination is YES, the routine goes to step 318 and the flag XL is cleared (0), and thus the feedback control is allowed to proceed (NO result at step 177 in FIG. 7).

Figure 15:
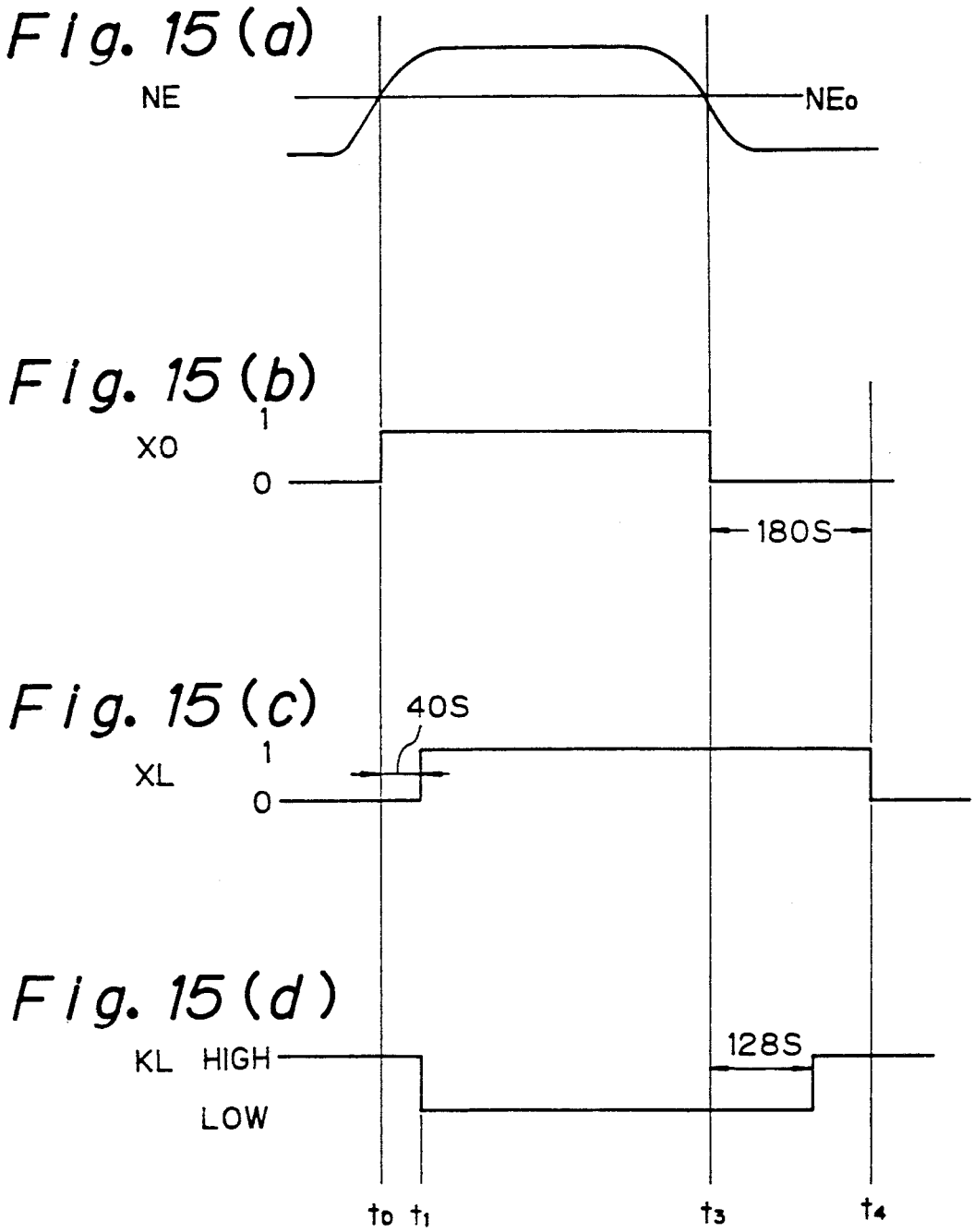
FIG. 15(*a*) to (*d*) are timing charts illustrating how flags are controlled by the execution of the routine in FIG. 11; and, FIG. 16(*a*) and (*b*) are timing charts illustrating how a duty signal for operating the heater in the lean sensor is obtained by the execution of the routine in FIG. 12.

FIG. 15(A) to FIG. 15(C) are timing charts illustrating the operation of the routine in FIG. 10. At a time $t_0$, the engine speed becomes higher than $NE_0$ (YES result at step 302) and the flag XO is set. Then, at a time $t_1$, 40 seconds have elapsed and the feedback prohibiting flag XL is set, and at a time $t_3$, the engine speed NE is made lower than $NE_0$ and the flag XO is cleared (step 312). Nevertheless, the feedback control is not allowed because XL=1 (YES at step 177). At a time $t_4$, 180 seconds have elapsed and the flag XL is cleared (step 318).

Figure 11:
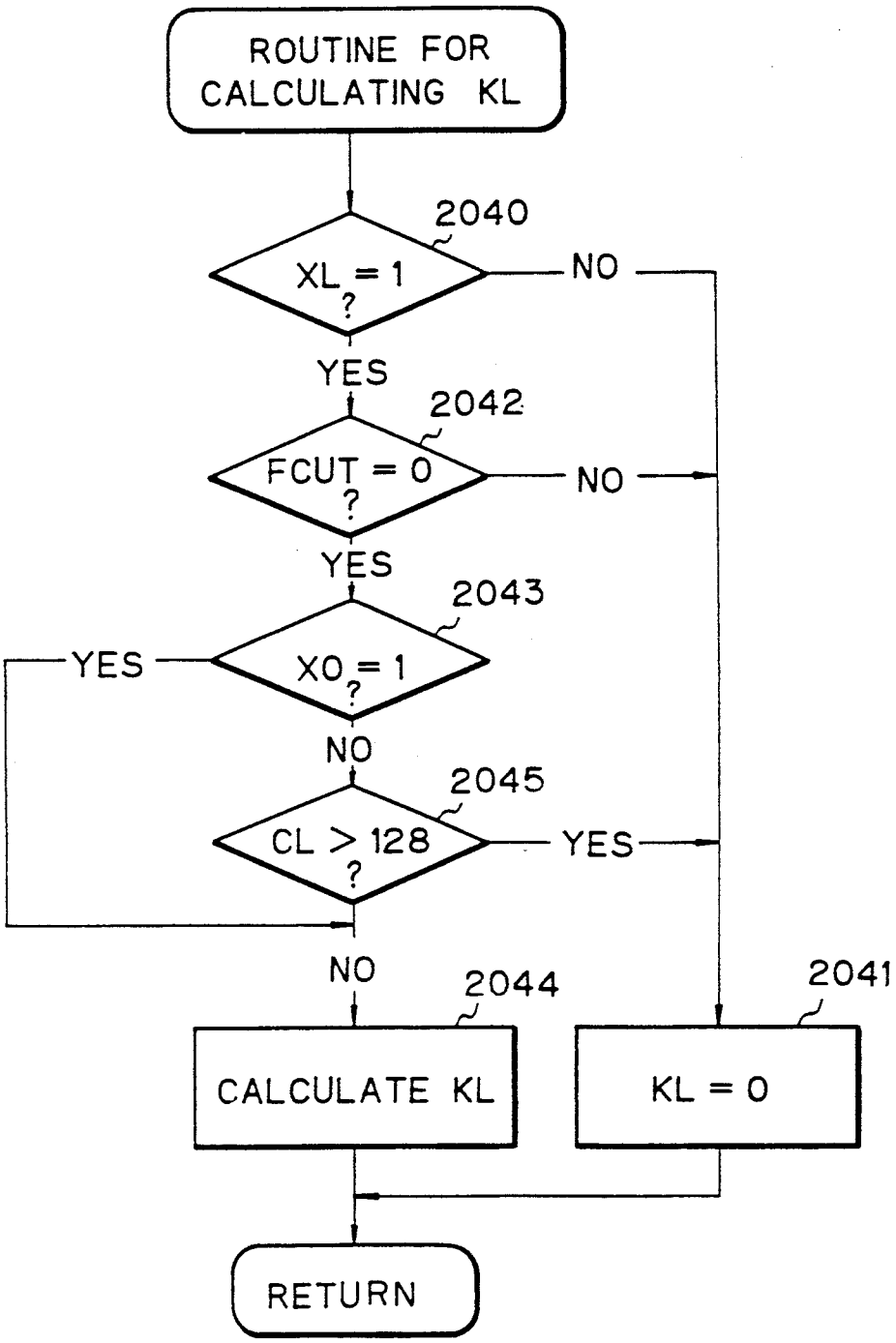

FIG. 11 shows step 204 in FIG. 8 in detail. At step 2040, it is determined if the flag XL=1, i.e., the air-fuel ratio feedback control, is prohibited. When it is determined that XL=0, i.e., the air-fuel ratio feedback control is not prohibited, the routine goes to step 2041 and the KL is cleared, and thus a heater power correction by KL is not carried out.

When it is determined that KL=1, i.e., the feedback control is prohibited, the routine goes to step 2042 where it is determined if the fuel cut flag FCUT=0. When it is determined that FCUT=1, i.e., the fuel cut operation is carried out (step 96 in FIG. 5), the routine goes to step 2041, and thus a heater power correction by KL is not carried out. The execution of the fuel cut can lower the exhaust gas temperature, and thus it is not necessary to lower the heater power even if XL=1, i.e., the engine speed higher than $NE_0$, is continued for longer than a predetermined time (40 seconds). Alternatively, to obtain a determination of the fuel cut condition, it is possible to calculate a rate of a total period of the fuel cut operation during the last 60 seconds, and to set the flag FCUT (1) when the fuel cut period rate for 60 seconds is larger than a predetermined value.

When it is determined that FCUT=0, i.e., a fuel cut operation is not carried out, the routine goes to step 2043 and it is determined if the flag XO=1. When XO=1, i.e., the engine speed larger than NE is continued, the routine goes directly to step 2044 and a heater power correction amount KL to the basic heater power Pmap is calculated. This correction amount KL is used for lowering the heater power when a high rotational speed condition of the engine is continued, to prevent an overheating of the sensor element of the lean sensor 75.

When it is determined that XO=0 at step 2043, i.e., the engine speed fell into a zone lower than $NE_0$ while the feedback control was prohibited (XL=1 at step 2040), the routine goes to step 2045 and it is determined if CL>128, i.e., 128 seconds have elapsed after the engine speed has fallen below $NE_0$. If the result is NO, the routine goes to step 2044 to continue the execution of the heater power correction operation by KL. When it is determined that CL>128 at step 2045, i.e., 128 seconds has elapsed, the routine goes to step 2041 to cancel the heater power reduction operation by KL.

FIG. 15(D) shows how the heater power correction KL is controlled. After 40 seconds has elapsed from a time $t_0$ when the engine speed NE exceeds the threshold $NE_0$, the correction of the heater power by KL is commenced. After 128 seconds has elapsed from a time $t_3$ at which the engine speed fell below the threshold value $NE_0$, the correction of the heater power by KL is stopped, and after 180 seconds has elapsed from $t_3$, the feedback is recommenced by a reset flag XL. This means that the electric power to the heater 75A of the lean sensor 75 is increased prior to the recommencing of the feedback control of the air-fuel ratio, and as a result, an excessive drop in the sensor element temperature is prevented prior to the commencement of the feedback control of the air-fuel ratio, whereby a precise control of the air-fuel ratio is attained.

Returning to FIG. 8, the steps generally illustrate the calculating for other correction amounts Pmapf applied to the heater power, which includes the increasing correction amount during a cold start condition Pcold, a correction amount due to a cooling of a transmitting element Prh, a correction amount for preventing an overheating of the sensor $P_{OTP}$, and others.

At step 208, a final electric power to the heater 75A of the lean sensor Pmap is calculated by $$Pmap = Pmapb + Pmapf - PmapTA - KL$$

At step 209, a duty ratio DUTY is calculated from the Pmap so that a pulse signal is applied to the heater 75A for obtaining an electric power Pmap calculated at the step 208. At step 210 a duty signal is formed for operating the heater 75A.

Figure 12:
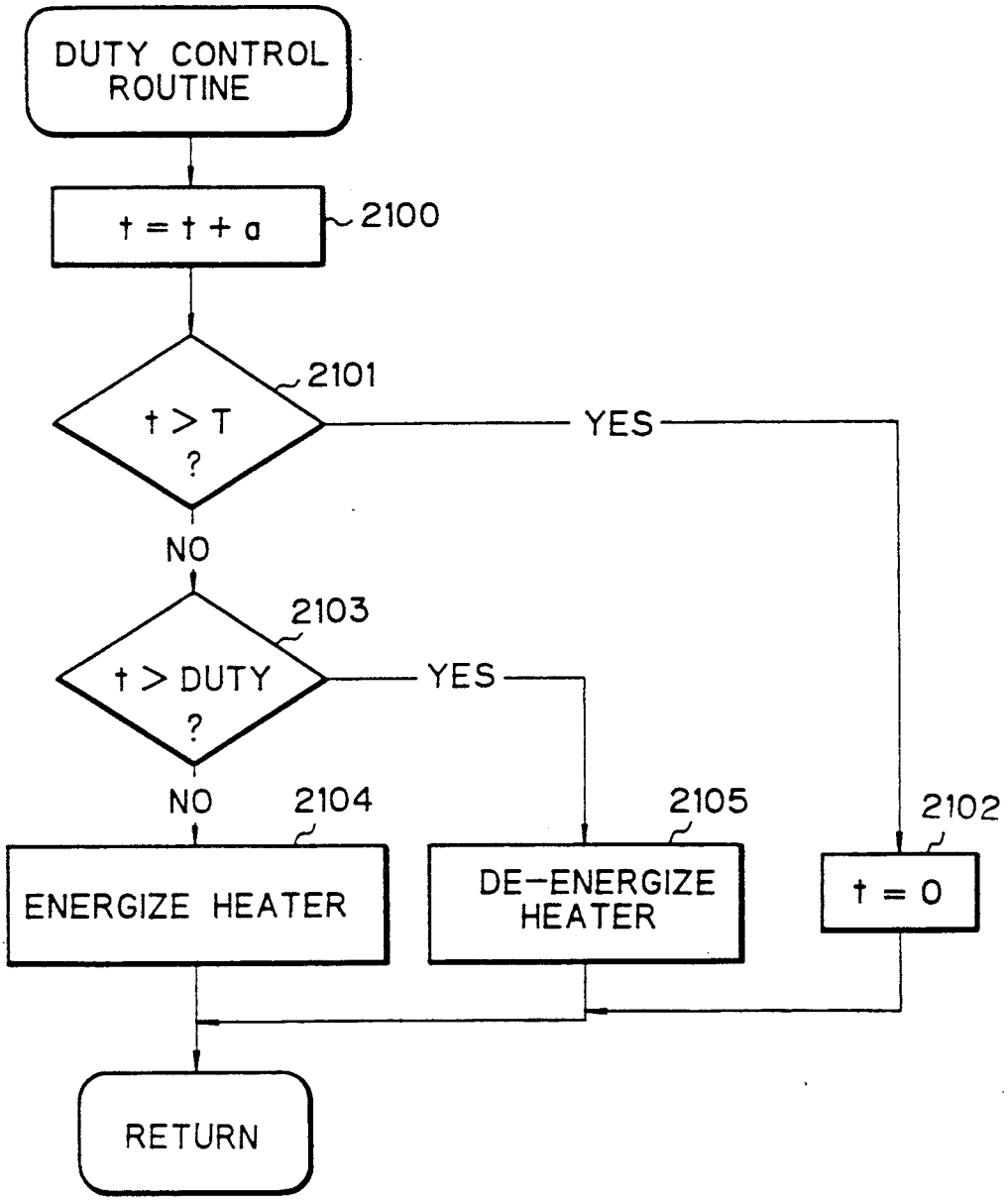

FIG. 12 shows the details of step 210. As already described, the routine is carried out at intervals of 2 milliseconds. At step 2100, a counter is incremented, and at step 2101 it is determined if t>T, i.e., a predetermined fixed timer T (=128 milliseconds) has elapsed, which corresponds to one cycle in the duty signal. When it is determined that t>T, the routine goes to step 2102 and the counter t is cleared. When it is determined that t<T at the step 2101, the routine goes to step 2103 and it is determined that t>DUTY has been calculated at step 209 in FIG. 8. When it is determined that t<DUTY, the routine goes to step 2104, a signal is issued to the transistor 75B in FIG. 1, which is thus made ON, to cause the heater 75A to be energized. When it is determined that t>DUTY, the routine goes to step 2105 and a signal is issued to the transistor 75B in FIG. 1, which is thus made OFF to cause the heater 75A to be deenergized.

Figure 16:
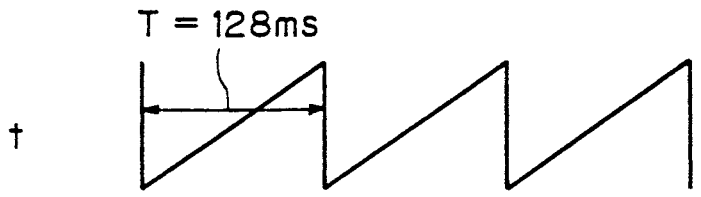
Figure 16:
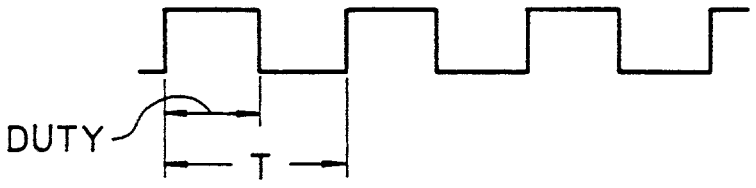

FIG. 16(*a*) shows how the value of the counter t is varied. The counter t is cleared (step 2102 in FIG. 12) at intervals of 128 milliseconds, which correspond to one cycle of the pulse signal for operating the heater 75A. As shown in FIG. 16(*b*), the heater 75A is energized for a period corresponding to the DUTY (step 2104), and thus a heater operating pulse signal having a duty ratio corresponding to the heater electric power Pmap calculated at the step 209 in FIG. 8 is obtained. As a result, a desired temperature of the sensing element of the lean sensor 75 is obtained and thermal damage to the sensing element is prevented.

Although an embodiment of the present invention is described herein with reference to the attached drawings, many modifications and changes can be made by those skilled in this art without departing from the scope and spirit of the present invention.

We claim:

1. A lean burn internal combustion engine, comprising: an engine body;

an intake line for introducing intake air into the engine body;

a throttle valve in said intake line for controlling the amount of air to be introduced into the engine body;

fuel supply means for supplying an amount of fuel into the intake line for producing a lean air-fuel mixture;

an exhaust line for a removal of the resultant exhaust gas from the engine body;

means for detecting an intake pressure in the intake line of the engine;

means for calculating, based on the detected intake pressure, a basic amount of fuel to be supplied to the engine;

means for detecting a degree of opening of the throttle valve;

means for correcting, based on the detected degree of opening of the throttle valve, the basic fuel amount needed to obtain a lean air-fuel mixture;

means for operating the fuel supply means so that the corrected amount of fuel is supplied into the engine body;

sensor means arranged in the exhaust system for detecting an air-fuel ratio, said sensor means having a sensing element in contact with the exhaust gas and a heater means for obtaining an activated temperature of the sensing element;

feedback means for carrying out a feedback control of the air-fuel ratio when necessary, so that the detected air-fuel ratio corresponds to the desired air-fuel ratio;

means, based on the detected intake pressure, for controlling the electric power in the heater means, and;

means, based on the degree of opening of throttle valve, for reducing an electric power in the heater from that obtained in accordance with the intake pressure, to thereby prevent an overheating of the sensor element.

2. An engine according to claim 1, further comprising means for detecting an altitude at which the engine is operating, and means for prohibiting a further reduction in the heater power when the engine is operating at a high altitude.

3. A lean burn internal combustion engine, comprising: an engine body;

an intake line for introducing intake air into the engine body;

a throttle valve in said intake line for controlling the amount of air to be introduced into the engine body;

fuel supply means for supplying an amount of fuel into the intake line for producing a lean air-fuel mixture;

an exhaust line for a removal of the resultant exhaust gas from the engine body;

means for detecting an intake pressure in the intake line of the engine;

means for calculating, based on the detected intake pressure, a basic amount of fuel supplied to the engine;

first means for correcting, based on the detected intake pressure, the basic fuel amount needed to obtain a lean air-fuel mixture;

means for detecting a degree of opening of the throttle valve;

second means for correcting, in place of the first correcting means and based on the detected degree of opening of the throttle valve, the basic fuel amount needed to obtain a lean air-fuel mixture when the degree of opening of the throttle valve is larger than a predetermined value;

means for operating the fuel supply means so that the corrected amount of fuel is supplied into the engine body;

sensor means arranged in the exhaust system for detecting an air-fuel ratio, said sensor means having a sensing element in contact with the exhaust gas and a heater means for obtaining an activated temperature of the sensing element;

feedback means for carrying out a feed back control of the air-fuel ratio when necessary, so that the detected air-fuel ratio corresponds to the desired air-fuel ratio;

means, based on the intake pressure as detected, for controlling the electric current in the heater means, and;

means, based on the degree of opening of the throttle valve, for reducing an electric current in the heater from that obtained in accordance with the intake pressure when the correction toward the lean air-fuel mixture is carried out by the second correction means, to thereby prevent an overheating of the sensor element.

4. A lean burn internal combustion engine, comprising: an engine body;

an intake line for introducing intake air into the engine body;

a throttle valve in said intake line for controlling the amount of air to be introduced into the engine body;

fuel supply means for supplying an amount of fuel into the intake line for producing a lean air-fuel mixture;

an exhaust line for a removal of the resultant exhaust gas from the engine body;

means for detecting an intake pressure in the intake line of the engine;

means for calculating, based on the detected intake pressure, a basic amount of fuel to be supplied to the engine;

means for detecting a degree of opening of the throttle valve;

means for correcting, based on the detected degree of opening of the throttle valve, the basic fuel amount needed to obtain a lean air-fuel mixture;

means for operating the fuel supply means so that the calculated amount of fuel is supplied into the engine body;

sensor means arranged in the exhaust system for detecting an air-fuel ratio, said sensor means having a sensing element in contact with the exhaust gas and a heater means for obtaining an activated temperature of the sensing element;

means, for detecting the engine speed;

feedback means for carrying out a feedback control of the air-fuel ratio when the engine speed is lower than a predetermined value so that the detected air-fuel ratio corresponds to the desired air-fuel ratio;

means, based on the detected intake pressure, for controlling the electric current in the heater means;

means, based on the degree of opening of the throttle valve, for reducing an electric current in the heater from that obtained in accordance with the intake pressure, to thereby prevent an overheating of the sensor element;

means for detecting a condition wherein an engine speed is higher than a predetermined value, and;

means for further reducing the electric current when the engine speed higher than the predetermined value is maintained for longer than a predetermined time.

5. An engine according to claim 4, further comprising means for allowing a further heater power reduction control to be first cancelled prior to the recovery of the feedback control when the engine speed is lower than the predetermined value.

6. An engine according to claim 4, further comprising means for detecting a fuel cut condition of the engine, and means for preventing the heater power from being further lowered when the fuel cut operation is carried out.

* * * * *